US006626708B2

(12) United States Patent
Phillips

(10) Patent No.: US 6,626,708 B2
(45) Date of Patent: Sep. 30, 2003

(54) SINGLE PIECE SPRING CONTACT

(75) Inventor: Michael J Phillips, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/822,134

(22) Filed: Mar. 30, 2001

(65) Prior Publication Data

US 2002/0142669 A1 Oct. 3, 2002

(51) Int. Cl.[7] ..... H01R 13/24
(52) U.S. Cl. ..... 439/700; 439/515
(58) Field of Search ..... 439/700, 824, 439/482, 66, 515

(56) References Cited

U.S. PATENT DOCUMENTS

| | | | | |
|---|---|---|---|---|
| 4,773,877 A | | 9/1988 | Kruger et al. | 439/482 |
| 4,778,404 A | | 10/1988 | Pass | 439/787 |
| 5,167,512 A | * | 12/1992 | Walkup | 439/66 |
| 5,362,262 A | | 11/1994 | Hotea | 439/839 |
| 5,427,545 A | | 6/1995 | Kourimsky et al. | 439/397 |
| 5,520,548 A | | 5/1996 | Hotea et al. | 439/358 |
| 5,611,717 A | | 3/1997 | Joly | 439/857 |
| 5,741,163 A | | 4/1998 | Hotea | 439/852 |
| 5,755,599 A | | 5/1998 | Hotea | 439/745 |
| 5,807,123 A | | 9/1998 | Spiegelaar et al. | 439/188 |
| 5,865,641 A | | 2/1999 | Swart et al. | 439/482 |
| 6,299,458 B1 | * | 10/2001 | Yamagami et al. | 439/66 |

FOREIGN PATENT DOCUMENTS

| | | |
|---|---|---|
| DE | 43 19 756 A1 | 12/1994 |
| EP | 0 718 918 A1 | 6/1996 |
| EP | 0 718 919 A1 | 6/1996 |
| WO | WO 94/11925 | 5/1994 |
| WO | WO 96/28865 | 9/1996 |

* cited by examiner

*Primary Examiner*—Javaid H. Nasri
(74) *Attorney, Agent, or Firm*—Baker & Daniels

(57) ABSTRACT

A one-piece electrical contact is disclosed which includes an upper movable contact portion and a lower and fixed contact portion, which is mountable to a printed circuit board. The top contact portion and printed circuit board portion are interconnected by way of an integral and intermediate sinuous spring. The top contact portion is skewed relative to the plane of the sinuous spring, whereby a force on the top contact portion, not only moves the sinuous spring in the vertically downward position, but also causes a lateral buckling of the spring, forcing the sinuous spring into the rail portions of a rear wall, whereby the electrical path from the contact portion to the printed circuit board contact portion is substantially reduced.

22 Claims, 7 Drawing Sheets

SINGLE PIECE SPRING CONTACT

BACKGROUND OF THE INVENTION

The subject invention relates to a one-piece electrical contact, and in particular to a spring-loaded contact which can be mounted to a printed circuit board.

DESCRIPTION OF THE PRIOR ART

It is common in certain applications, for example, in the application of the portable hand set telephone, to have an electrical connection between a charging unit of the base portion of the telephone connected to the battery of the hand-held phone. Such an electrical connector is usually comprised of a spring contact portion, which is cylindrical in shape and includes a compression spring mounted within the cylinder, and a plunger contact portion held to the cylindrical portion yet spring loaded by the spring. The contact is surface mountable to a printed circuit board, whereby upon placement of the handset in the base or cradle of the telephone, the contacts on the handset engage and deflect the spring-loaded portion of the contact in the base to charge the battery in the handset.

While this electrical contact is suitable for the application as described, in that the contact has to be somewhat rigid and self-sustaining, the contact can be expensive due to the many expensive components of the contact as well as the labor intensiveness of its manufacture.

Another prior art connector system is shown in PCT Publication WO96/28865. While this connection system is suitable for the application in which it is disclosed, other applications have arisen requiring a modification as mentioned above.

Other contact systems, for example, U.S. Pat. Nos. 5,362,262; 5,427,545; and 5,520,548 show contact systems having an internal movable portion for contact with a pin, with an outer box-shaped backup member.

SUMMARY OF THE INVENTION

The objects of the invention have been accomplished by providing an electrical contact comprised of a first contact portion and a second contact portion, and an intermediate spring portion therebetween. The first contact portion is movable relative to the second contact portion through the spring, between a first position where the spring is in a free state, and a second position where the spring is deflected and the first and second contact portions are electrically interconnected. This provides that the electrical path between the first and second contact portions is shortened.

In the preferred embodiment of the invention the spring is sinuous in shape and the first contact member is a plunger contact. Furthermore, the second contact member is defined as a printed circuit board contact.

Also in the preferred embodiment, the spring portion is a sinuous spring which lies in a plane. A rear wall is positioned adjacent to the spring, electrically connecting the second contact portion, and having contact surfaces positioned adjacent to the first contact portion. The first contact portion extends integrally from a first end of the sinuous spring and the second contact extends integrally from a second end of the sinuous spring. The first contact portion extends integrally from a first end of the sinuous spring and the first contact portion is directed in a plane extending towards the contact surfaces, whereby when the first contact member is engaged, the sinuous spring is deflected, and the first contact member is directed into engagement with the contact surfaces. The rear wall is integrally formed with the second contact by a reverse bend, with the rear wall lying in a plane parallel with the sinuous spring. The contact surfaces are defined by rail portions being bent from the rear wall and having edges positioned adjacent to the spring. The electrical contact furthermore has a front wall defined by a second reverse bend adjacent the first contact portion and is positioned in a plane substantially parallel with the sinuous spring.

In yet another embodiment of the invention, a one-piece contact is comprised of a first contact portion and a second contact portion, and an intermediate spring portion therebetween. The first contact portion is movable relative to the second contact portion through the spring, and the contact further comprises an integral rear wall extending from the second contact portion through a reverse bend. A front wall portion extends integrally from the rear wall portion through a second reverse bend.

In the preferred embodiment of the invention, the second reverse bend is provided with an opening, and the first contact member is a plunger contact, extending upwardly through the opening. The first contact portion is movable relative to the second contact portion through the spring, between a first position where the spring is in a free state, and a second position where the spring is deflected and the first and second contact portions are electrically interconnected, whereby the electrical path between the first and second contact portions is shortened. The spring portion is a sinuous spring which lies in a plane. The second contact member is a printed circuit board contact.

Preferably, the first contact portion extends integrally from a first end of the sinuous spring and the first contact portion is directed in a plane extending towards the contact surfaces, whereby when the first contact member is engaged, the sinuous spring is deflected, and the first contact member is directed into engagement with the contact surfaces. The contact surfaces are defined by rear wing portions being bent from the rear wall and having edges positioned adjacent to the spring. The wing portions are defined by a transverse bend, with the edges being positioned in a plane substantially parallel with the spring. The electrical contact further comprises front wing portions extending from the front wall with edges being positioned in a plane substantially parallel with the spring, whereby the front and rear wing portions define a guide channel for the deflection of the sinuous spring.

DETAILED DESCRIPTION OF THE PREFERRED EMBODIMENT

Figure 1:
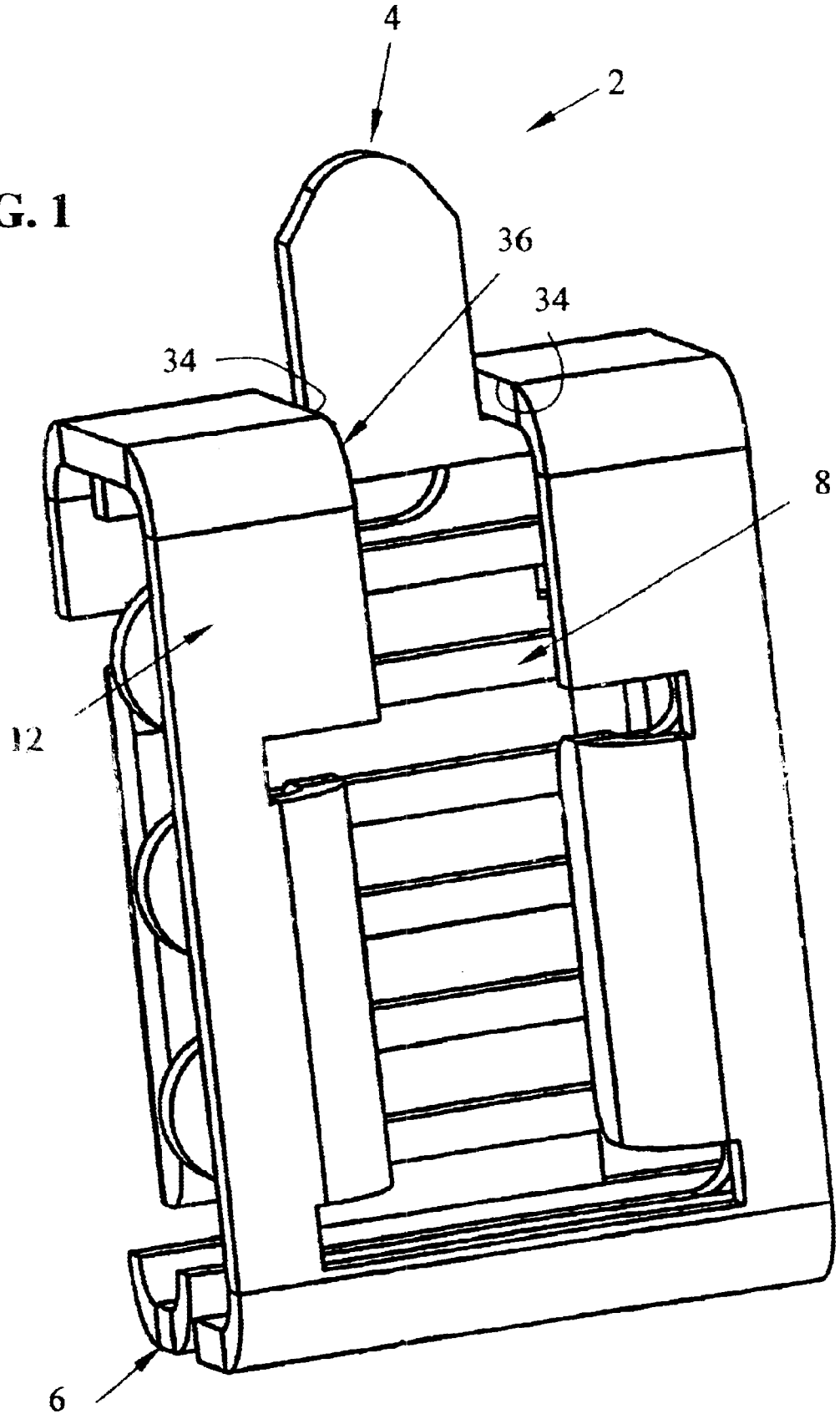
FIGS. 1 and 2 are perspective views of the subject contact taken from different angles.
Figure 2:
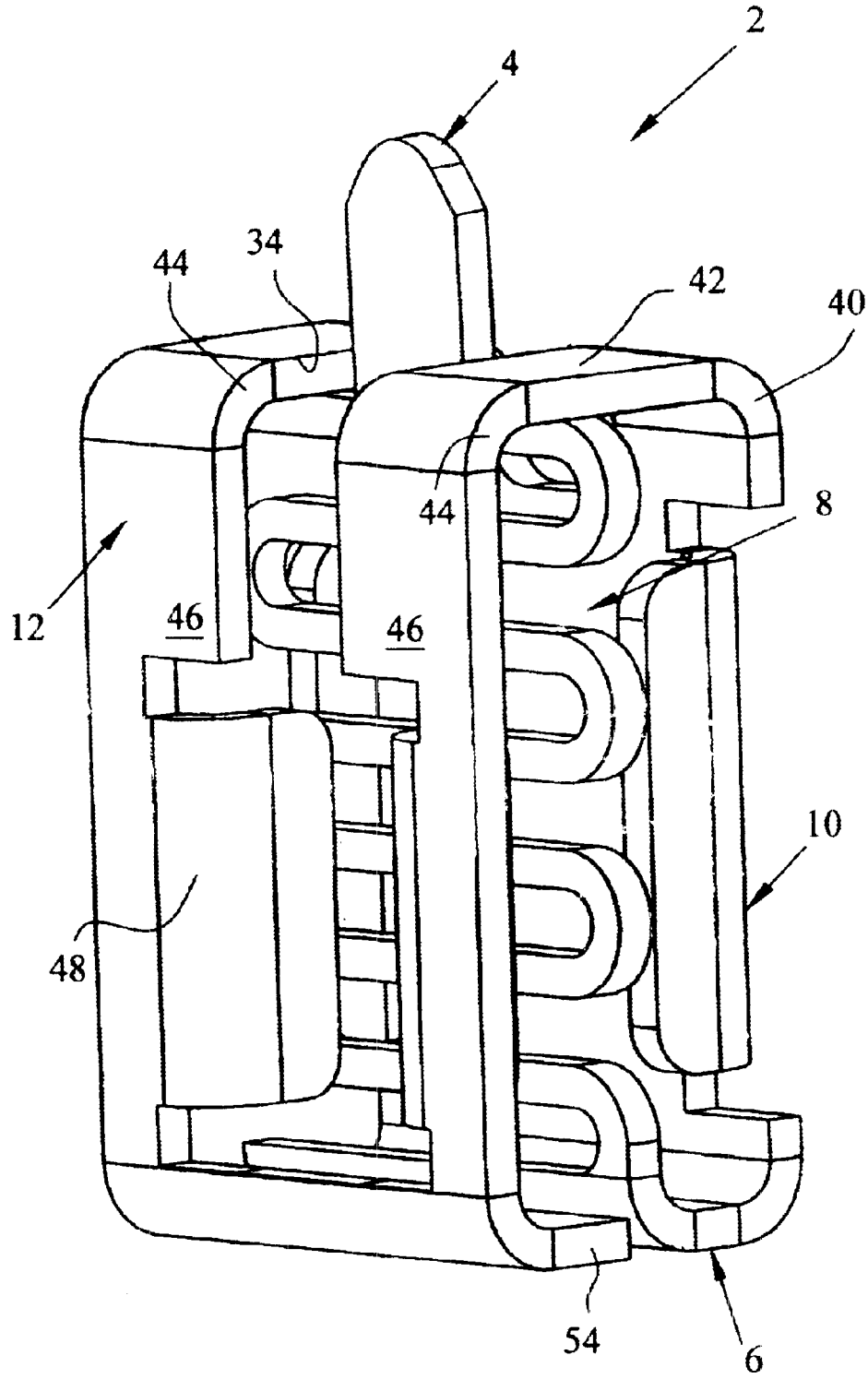
Figure 4:
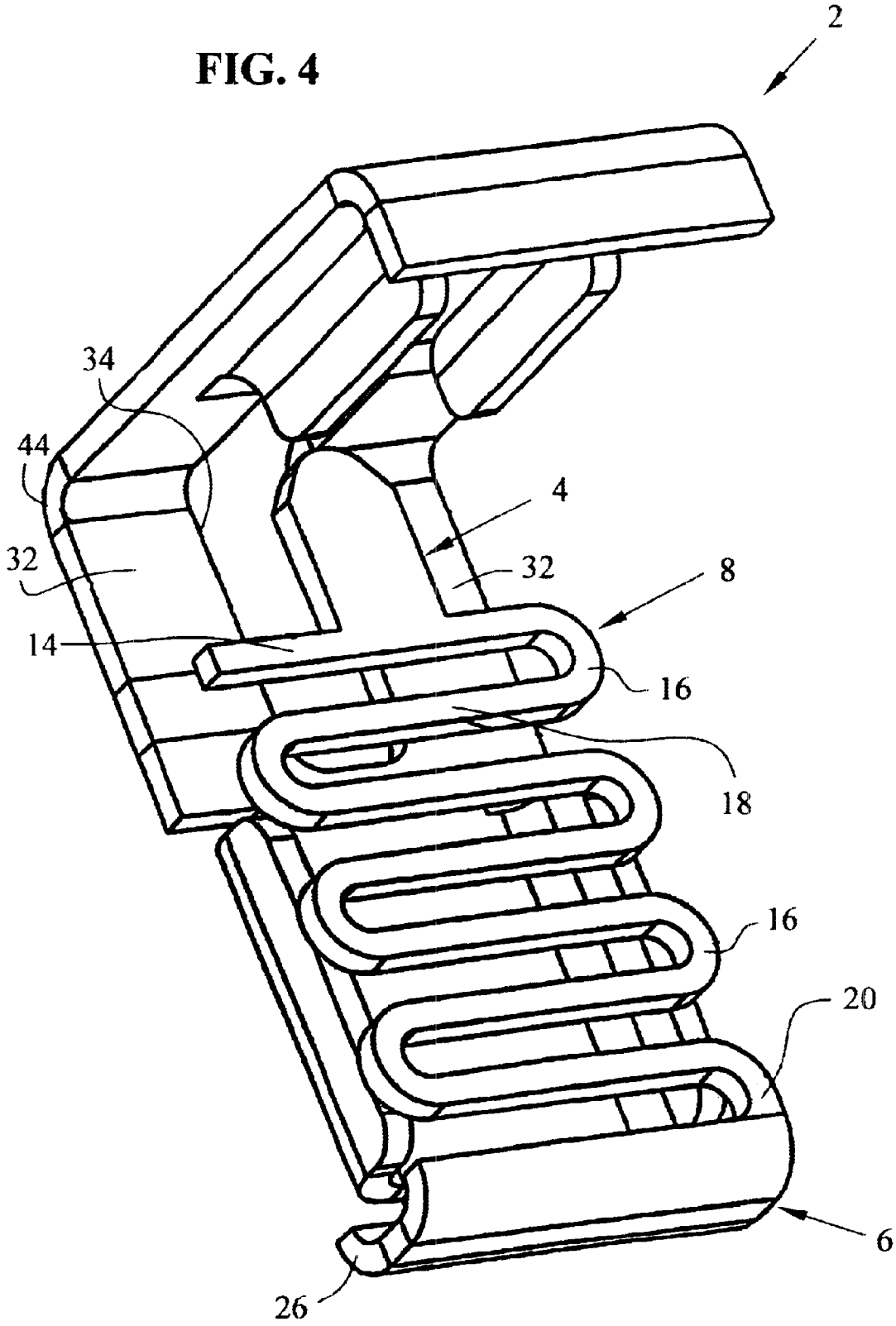
FIG. 4 is a perspective view of the contact of FIGS. 1 through 3 above showing the front wall portion moved away from the sinuous spring.

With reference first to FIGS. 1 and 2, an electrical contact 2 is shown, generally comprising a top contact portion 4, shown as a plunger contact, with a printed circuit board contact 6 at the opposite end, where the contact portions 4 and 6 are interconnected by way of a spring member 8. In the preferred embodiment of the invention, the spring member 8 is a sinuous spring, as will be described in greater detail. The contact 2 further comprises a rear wall portion 10, which extends integrally upwardly from the contact portion 6 and further comprises a front wall portion shown at 12. With reference now to FIG. 4, the contact member 2 is described in greater detail.

The contact 4 is integrally formed with the sinuous spring 8 and includes a cross bar portion 14 leading into the sinuous spring 8. The sinuous spring 8 is comprised of spring end portions 16 and laterally extending portions 18. The sinuous spring 8 is then interconnected to the printed circuit board contact portion 6 by way of radiused section 20. As shown best in FIG. 3, surface mount contact portion 6 is comprised of a first radiused section 22, which transitions from the plane of the sinuous spring to a flat mounting portion 24 and then continues into a second radiused section at 26. The radiused sections 22 and 26 define a reverse bend to project the rear wall 10 upwardly in a plane substantially parallel to the plane of the sinuous spring. As shown best in FIG. 3, the rear wall 10 includes wing portions 28 formed transversely of the rear wall and defines contact surfaces at 30 positioned adjacent to sinuous spring 8, but in a noncontacting relation.

With reference again to FIG. 4, two strap portions 32 extend upwardly from the rear wall portion 10 having inner side edges at 34, thereby defining opening at 36. The strap portions are bent through a first radiused portion 40, to define top shoulders 42 (FIG. 2), which are continuous through second radiused portions 44. The strap portions 32 are again reversely bent to define front strap portions 46 and thus front wall portion 12. Front wing portions 48 are stamped and formed from the front wall portion 12 and are transversely bent relative to the plane of front wall 12 to define edges at 50. Strap portions 46 continue downwardly and are bent at radiused section 52, thereby defining stabilizing foot portion at 54. Finally, with respect to FIG. 3, it should be appreciated that the sinuous spring lies along a plane 60, whereas the contact portion 4 is skewed at an angle Φ, as will be further described herein.

Figure 5:
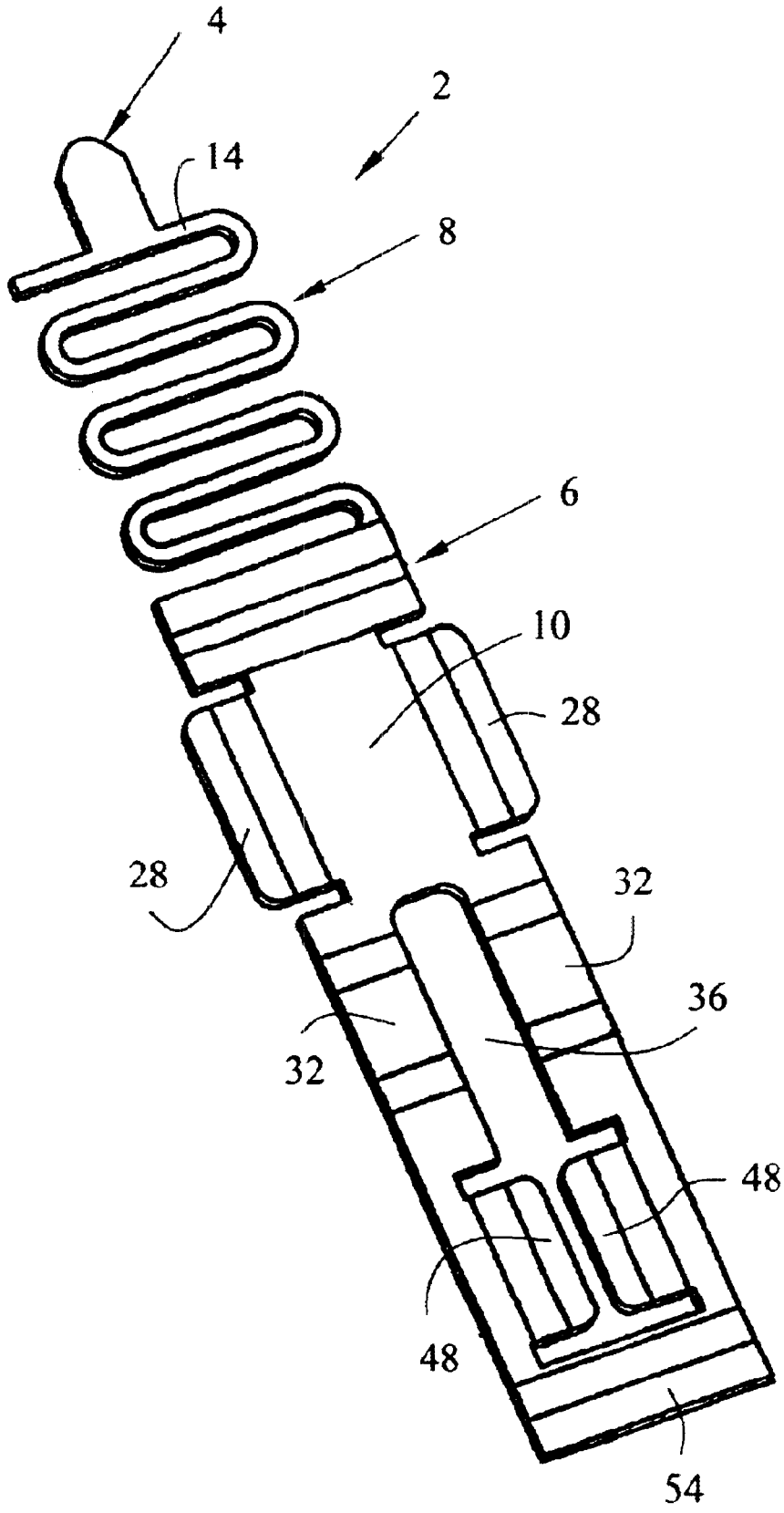
FIG. 5 shows the contact in the flat blank stage after stamping, but prior to forming.

With respect now to FIG. 5, the contact 2 is shown in the flat blank state, where the contact portion 4 is interconnected to the sinuous spring 8 by way of the cross bar 14. At the opposite end of the sinuous spring 8 is the portion of the flat blank which forms the lower or printed circuit board contact 6. Extending integrally from the printed circuit contact 6 is the rear wall 10 having along the side edges thereof, wing portions 28. Strap portions 32 extend from the rear wall portion 10, thereby defining the opening at 34. Wing portions 48 are shown in the preformed position, and stabilizing foot 54 is shown prior to forming as well.

Figure 3:
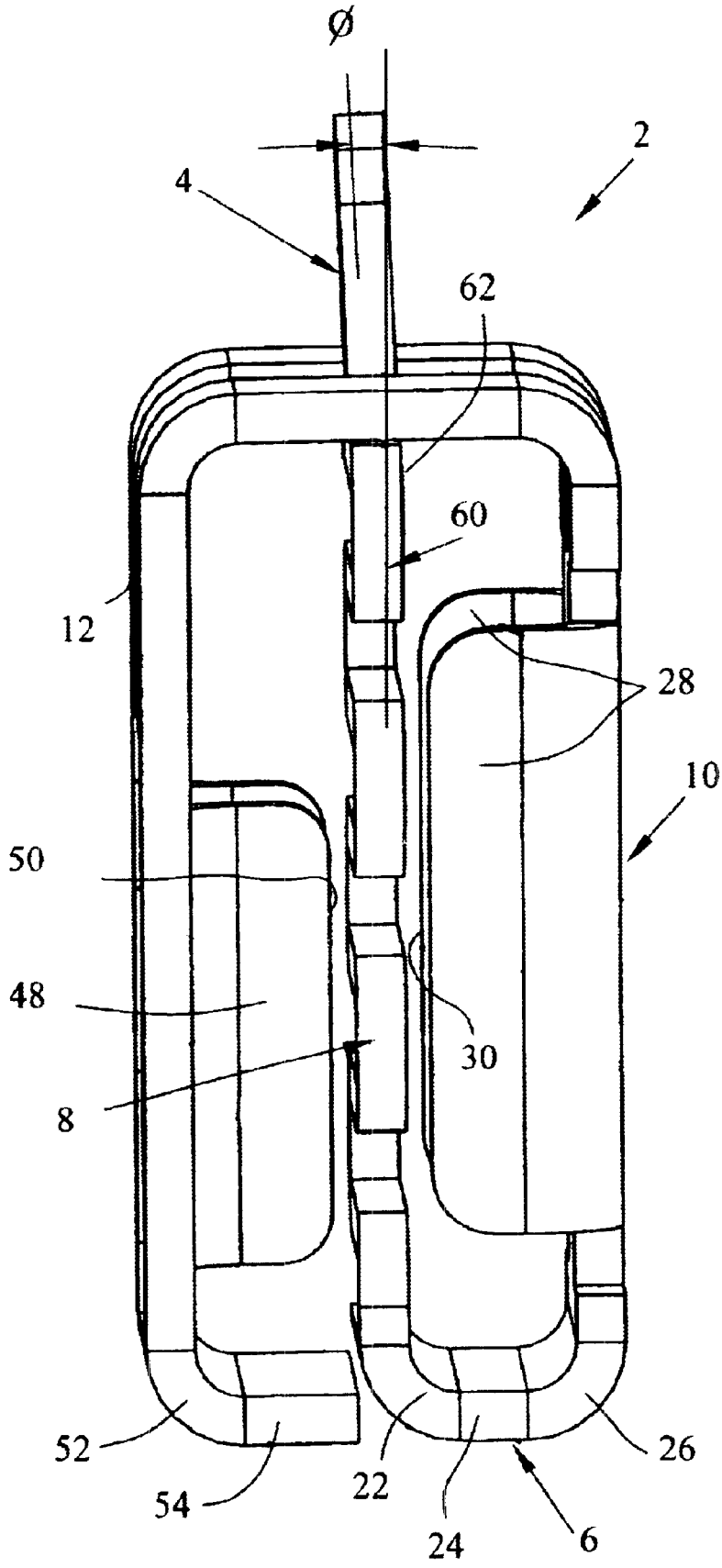
FIG. 3 is a perspective view of the contact of FIG. 1 or 2 taken from a left-hand side thereof.

To form the terminal shown in FIGS. 1 through 3, the wing portions 28, 48 are first formed to lie in a transverse direction to the plane shown. The first formation occurs at radiused sections 22 and 26, which thereby positions edges 30 adjacent to the inner surface of the sinuous spring. The front radiused section 44 is thereafter formed, which places the contact 2 in the position shown in FIG. 4. The second radiused section 40 is thereafter formed, which positions the strap portions 32 in a flanking position relative to the contact member 4, such that the contact member 4 extends through the opening 34. This positions front strap portions 46 in a substantial parallel condition with the plane of the sinuous spring 8 as well as with the plane of the rear wall portion 10. This also places the edges of the wing portions 48 adjacent to the spring member 8.

In the preferred embodiment of the invention, the contact is formed such that there is a slight contact between upper portions 42 and the cross bar member 14, thereby adding a slight preload to the contact member 4 within the sinuous spring 8. As also formed, the contact portion 4 lies in a skewed plane relative to plane 60, as best shown in FIG. 3, where an angle Φ lies between the two planes, as best shown in FIG. 3, and described below.

Figure 6:
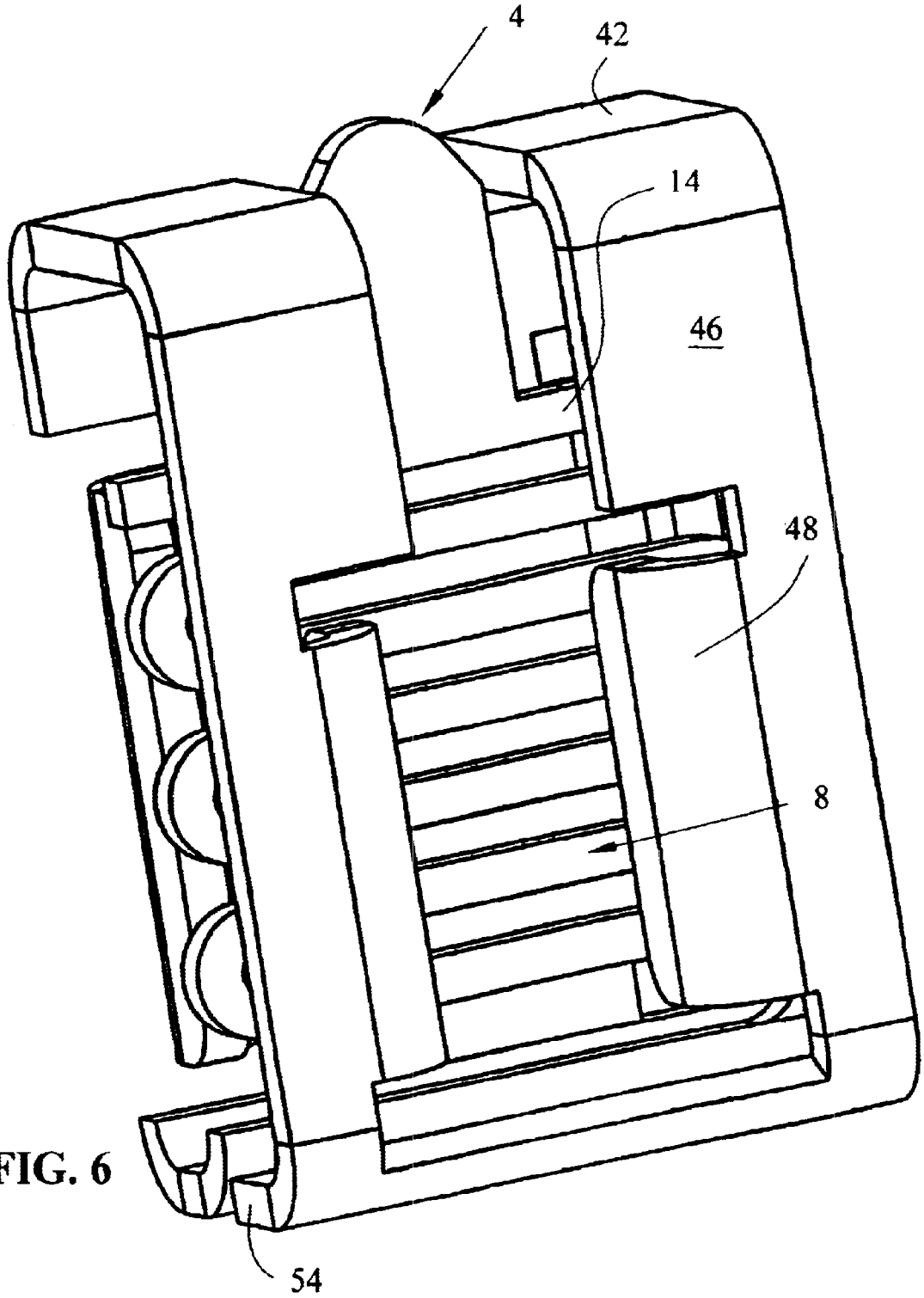
FIG. 6 is a front perspective view of the contact in the deflected state.
Figure 7:
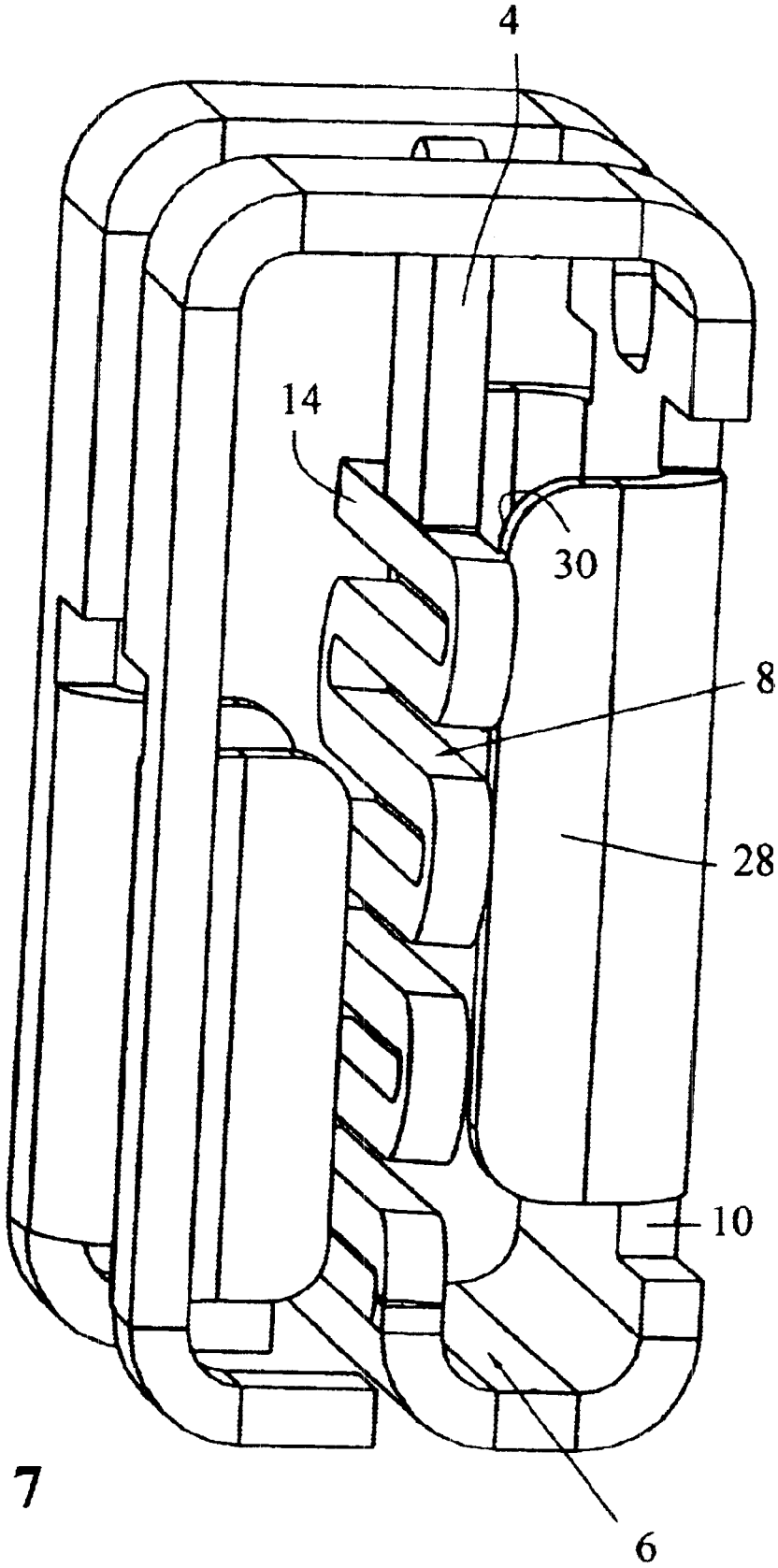
FIG. 7 is a side perspective view of the contact in the deflected state.

In application then, the contact 2 can be soldered to a printed circuit board, where the surface mount contact portion 6 can be positioned against a corresponding contact pad and soldered in place. When the counterpart contact (not shown) is placed against contact portion 4 of contact member 2, and pushed downwardly, the lateral spring portions 18 give way about their end radiused sections 18 to provide spring deformation as shown in FIG. 6. It should be appreciated that the top portions 42 not only act as the counterpart to define the top extent of the spring location, it also defines the extent to which the contact 4 can be deflected downwardly. At the same time, due to the skewed angle Φ, when the contact portion 4 is pushed downwardly, the spring buckles somewhat as shown in FIG. 7, such that the surface 62 of the cross bar 14 is pushed against the edges 30 of the wing portions 28. Advantageously, this shortens the electrical path from the contact portion 4 to the wing portions 28 directly to the printed circuit board contact portion 6. It should be obvious then that the electrical path bypasses the sinuous spring 8, which not only would elongate the path, but would subject the electrical path to the inherent impedance of the sinuous shape. Advantageously, the contact 6 provides the advantages of the supple spring contact with good electrical characteristics by way of the shortened resistive path.

I claim:

1. An electrical contact comprised of a first contact portion and a second contact portion, and an intermediate spring portion therebetween connecting said first and second contact portions, and a rear wall positioned adjacent to said intermediate spring portion and electrically connected to said second contact portion, said rear wall being integrally formed with said second contact by a reverse bend, with said rear wall lying in a plane substantially parallel with said spring, a third contact portion positioned on said rear wall and extending adjacent to said first contact portion and in electrical connection with said second contact portion, said first contact portion extending integrally from a first end of said spring and said first contact portion being directed in a plane extending towards said third contact portion, said first contact portion being movable relative to said second contact portion through said spring, between a first position where said spring is in a free state and said first contact portion is not in contact with said third contact portion, and a second position where said spring is deflected laterally rearward, towards said rear wall and into engagement with said third Contact portion, and said first and second contact portions are electrically interconnected by way of said third contact portion, whereby an electrical path between the first and second contact portions is shortened.

2. The electrical contact of claim 1, wherein said spring is sinuous in shape.

3. The electrical contact of claim 1, wherein said first contact portion is a plunger contact.

4. The electrical contact of claim 1, wherein said second contact portion is a printed circuit board contact.

5. The electrical contact of claim 1, wherein the spring portion is a sinuous spring which lies in a plane.

6. The electrical contact of claim 1, wherein said third contact portion is defined by rail portions being bent from said rear wall and having edges positioned adjacent to said spring.

7. The electrical contact of claim 6, wherein said rail portions have contact surfaces which extend in an axis parallel with an axis of spring displacement.

8. The electrical contact of claim 7, wherein said first contact and spring are interconnected by a crossbar, said crossbar extending transversely of said contact surfaces.

9. The elect hical contact of claim 8, wherein said spring is a sinous spring extending integrally from said crossbar.

10. The electrical contact of claim 1, wherein a front wall is defined by a second reverse bend adjacent said first contact portion and is positioned in a plane substantially parallel with said spring.

11. The electrical contact of claim 10, wherein said front wall and rear wall overlap said spring, with said spring being movable between said front and rear wall.

12. The electrical contact of claim 1, wherein said spring is sinuous.

13. The electrical contact of claim 1, wherein said first contact portion lies in a plane angled relative to said spring, whereby when said first contact portion is deflected, said first contact portion and said spring are moved towards said third contact portion.

14. An electrical one-piece contact comprised of a first contact portion and a second contact portion, and an intermediate spring portion therebetween, said first contact portion being movable relative to said second contact portion through said spring, said contact further comprising an integral rear wall extending from said second contact portion through a reverse bend, and a front wall portion extending integrally from said rear wall portion through a second reverse bend, said front and rear walls overlapping said spring with said spring being movable between said front and rear walls.

15. The electrical contact of claim 14, wherein said rear wall further comprises contact surfaces positioned adjacent to said first contact portion, said contact surfaces being electrically commoned to said second contact portion through said rear wall.

16. The electrical contact of claim 15, wherein said second reverse bend is provided with an opening, and said first contact portion is a plunger contact, extending upwardly through said opening.

17. The electrical contact of claim 15, wherein said first contact portion is movable relative to said second contact portion through said spring, between a first position where said spring is in a free state, and a second position where said spring is deflected and said first contact portion is commoned to said contact surfaces and said first and second contact portions are electrically interconnected, whereby the electrical path between the first and second contact portions is shortened.

18. The electrical contact of claim 17, wherein the spring portion is a sinuous spring which lies in a plane.

19. The electrical contact of claim 17, wherein said first contact portion extends integrally from a first end of said spring and said first contact portion is directed in a plane extending towards said contact surfaces, whereby when said first contact portion is engaged, said spring is deflected, and said first contact portion is directed into engagement with said contact surfaces.

20. The electrical contact of claim 19, wherein said contact surfaces are defined by rear wing portions being bent from said rear wall and having edges positioned adjacent to said spring.

21. The electrical contact of claim 20, wherein said wing portions are defined by a transverse bend, with said edges being positioned in a plane substantially parallel with said spring.

22. The electrical contact of claim 21, further comprising front wing portions extending from said front wall with edges being positioned in a plane substantially parallel with said spring, whereby said front and rear wing portions define a guide channel for the deflection of said spring.

* * * * *

UNITED STATES PATENT AND TRADEMARK OFFICE

CERTIFICATE OF CORRECTION

PATENT NO. : 6,626,708 B2 
DATED : September 30, 2003
INVENTOR(S) : Michael J. Phillips It is certified that error appears in the above-identified patent and that said Letters Patent is hereby corrected as shown below:

Column 4,
Line 53, delete “Contact” and insert -- contact --

Column 5,
Line 7, delete “elect hical” and insert -- electrical --

Signed and Sealed this

Eleventh Day of November, 2003

JAMES E. ROGAN
*Director of the United States Patent and Trademark Office*